United States Patent [19]

Sutliff et al.

[11] 4,261,427

[45] Apr. 14, 1981

[54] LONG STROKE JAR BUMPER SUB WITH SAFETY SLEEVE

[76] Inventors: Wayne N. Sutliff; Jim L. Downen, both of 2931 Pierce Rd., Bakersfield, Calif. 93308

[21] Appl. No.: 84,715

[22] Filed: Oct. 15, 1979

[51] Int. Cl.[3] ..... E21B 1/10

[52] U.S. Cl. ..... 175/297; 64/23; 267/125

[58] Field of Search ..... 267/125; 175/320, 321, 175/297, 296; 64/1V, 23

[56] References Cited

U.S. PATENT DOCUMENTS

| | | | |
|---|---|---|---|
| 2,989,132 | 6/1961 | Downen | 175/297 |
| 3,889,766 | 6/1975 | Sutliff et al. | 175/297 |
| 4,054,040 | 10/1977 | Medders | 175/321 |
| 4,081,043 | 3/1978 | Juergens | 175/297 |
| 4,109,736 | 8/1978 | Webb et al. | 175/297 |
| 4,173,130 | 11/1979 | Sutliff et al. | 175/321 |
| 4,210,316 | 7/1980 | Hall | 267/125 |

*Primary Examiner*—Edward R. Kazenske
*Attorney, Agent, or Firm*—Dana E. Keech

[57] ABSTRACT

A hydraulic jar apparatus to be disposed in a drilling string embodying inner and outer telescopically arranged elements. Overlapping portions of the elements provide an annual chamber confining an operating liquid by an annular seal fixed to the outer element at the lower end of the chamber and an annular Polly Pack seal fixed to the outer element at the upper end of the chamber. A piston is extended radially from the inner element into the chamber and the chamber is divided by a cylinder on the outer element into low and high pressure sections. Impact shoulders are provided on the elements in axially opposed relation to produce a jarring blow and the elements are telescopically coupled by a hexagonal spline sub assembly.

5 Claims, 9 Drawing Figures

LONG STROKE JAR BUMPER SUB WITH SAFETY SLEEVE

Summary of the Invention

Patterned generally on the Downen Jar disclosed in U.S. Pat. No. 2,989,132, the invention retains the ruggedness of its antecedent in enduring down spudding while expanding the range of jarring pressures endured from 40,000 pounds to 90,000 pounds. This radical improvement followed replacing the keyed spline with a hex spline section and excluding this from the hydraulic jarring control oil chamber and also locating the impact jar faces externally from said chamber, for lubrication entirely by ambient fluid, and transmitting the jarring up blow of the tool directly from the lower end of the external sleeve of the jar to the upper end of the male hexagonal spline sub. Opposed internal female splined sub and external short collar screwed into and onto said sleeve and sub, respectively, and readily replaceable, provide the juxtaposed jar impact faces, thus greatly strengthening the jar and simplifying its servicing.

A separate metering sub heavily reinforces the midsection of the outer protective draft sleeve of the tool and protects the metering sleeve and its hydraulic chamber from damage, besides lessening machining costs. A safety sleeve supported by the metering sub through matching ground end faces retards "down bumper" movements when resetting the tool for a jarring operation to prevent these damaging the tool, due to spudding the tool.

Figure 1:
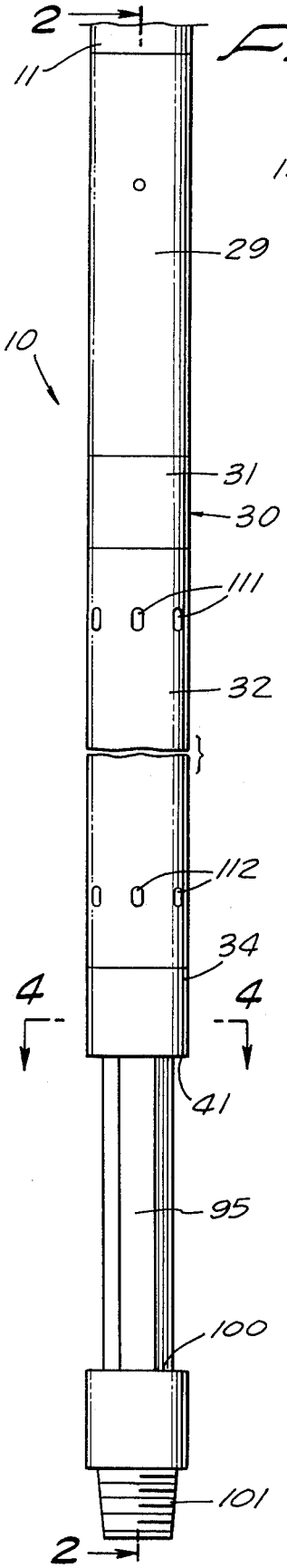
FIG. 1 is a diagrammatic side elevational view of a preferred embodiment of the tool of the invention, shown in fully extended jarring position.

FIG. *2a, 2b, 2c,* and *2 d* are a composite half-scale quarter sectional view taken on the line 2—2 in FIG. 1.

Figure 3:
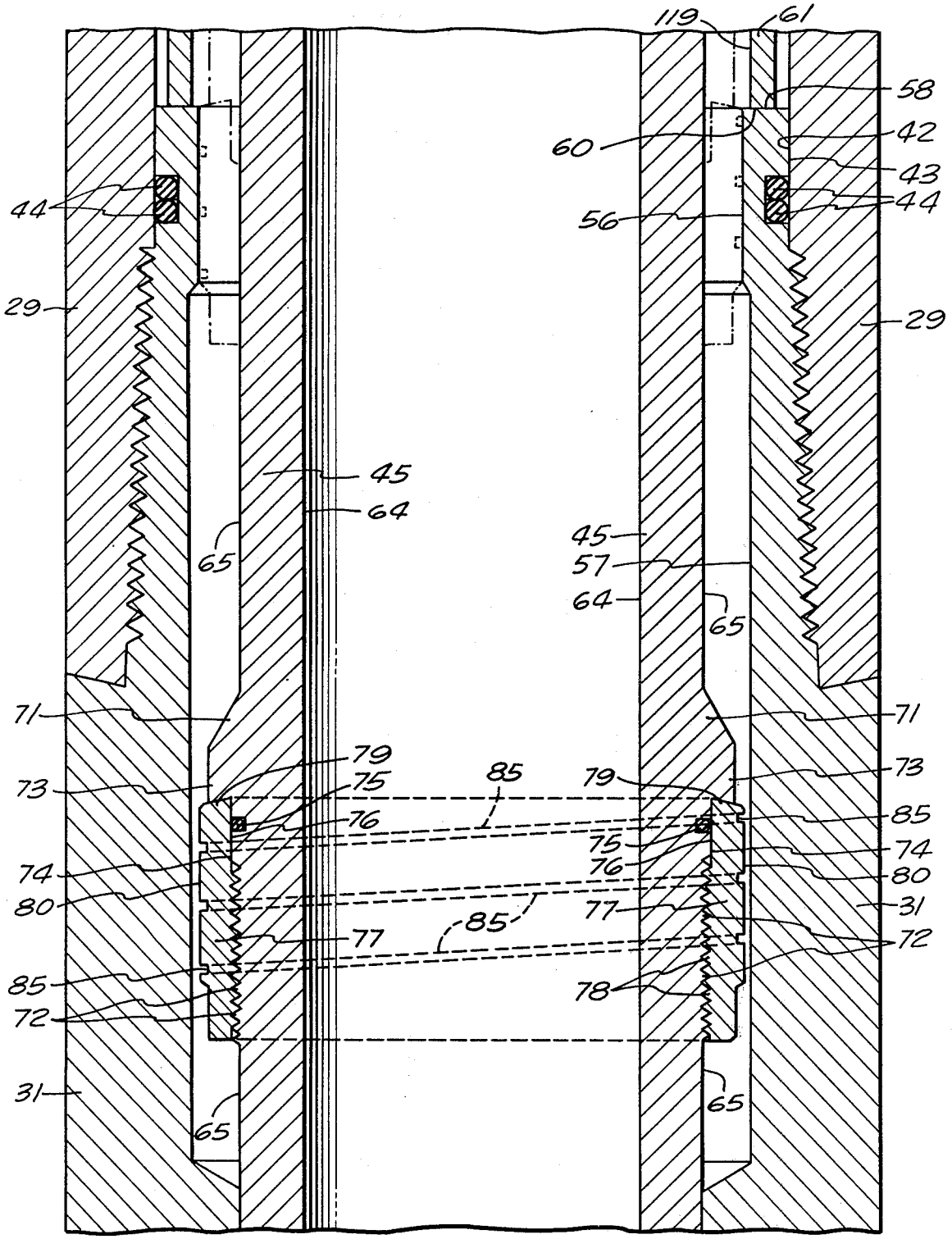

FIG. 3 is a full scale vertical cross sectional view taken on the line 2—2 of FIG. 1 particularly showing the metering sub and metering sleeve of the invention with the latter in full lines in jar resetting or bumper subbing position, and in broken lines with the metering sleeve passing through the controlling restricted area of said sub, either upwardly, as when tensioning the drill string in preparation for jarring, or downwardly, as when resetting the tool for starting an upjarring stroke or in delivering a bumper sub down-stroke.

Figure 4:
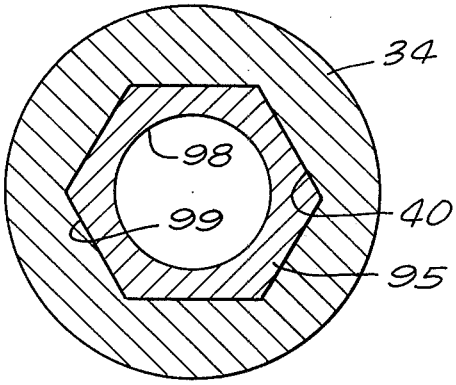

FIG. 4 is an enlarged cross sectional view of the hexagonal spline zone of the invention taken on line 4—4 of FIG. 1.

Figure 5:
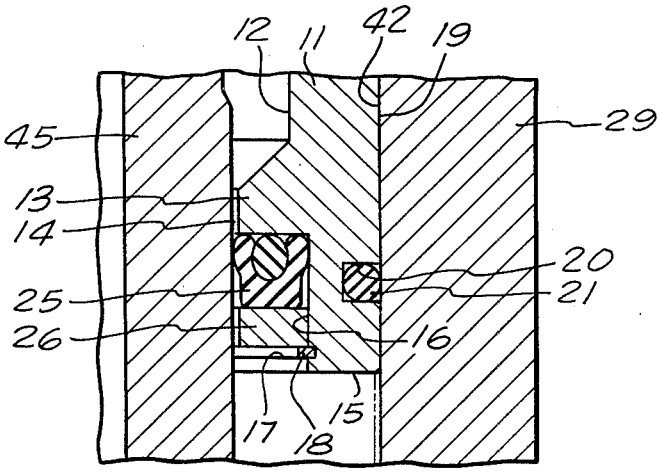
Figure 2A:
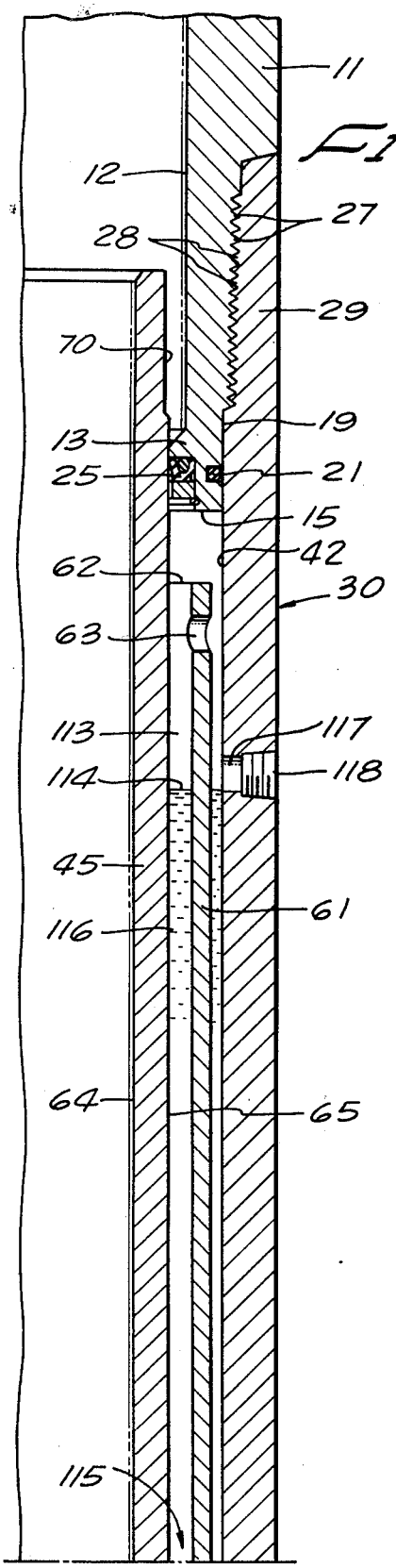
Figure 2B:
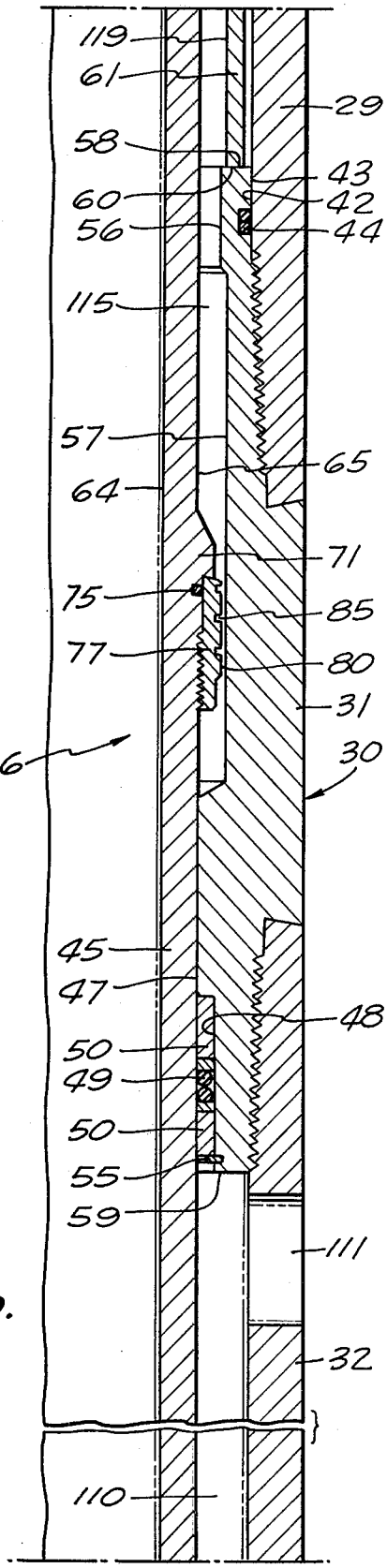
Figure 2C:
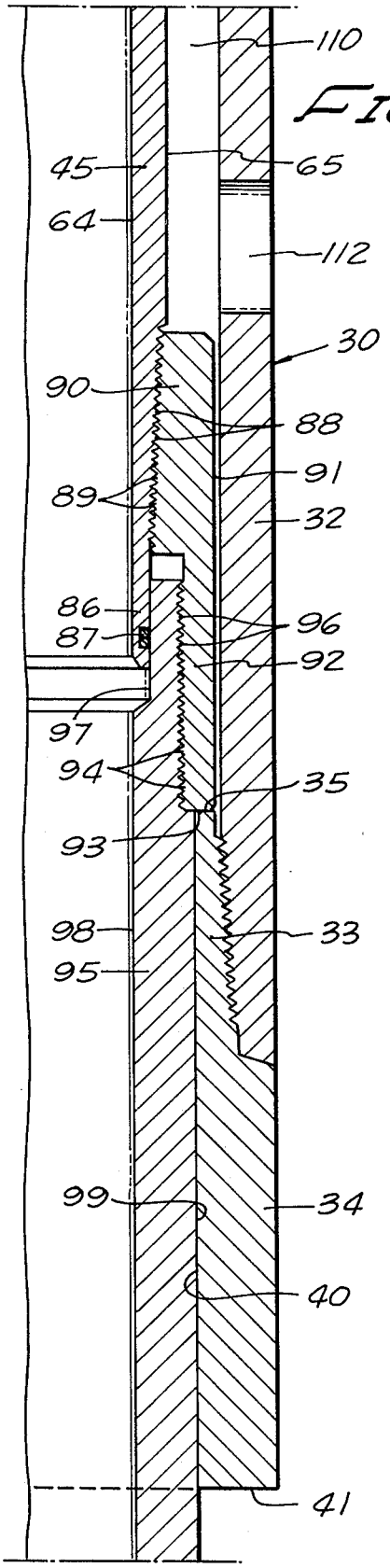
Figure 2D:
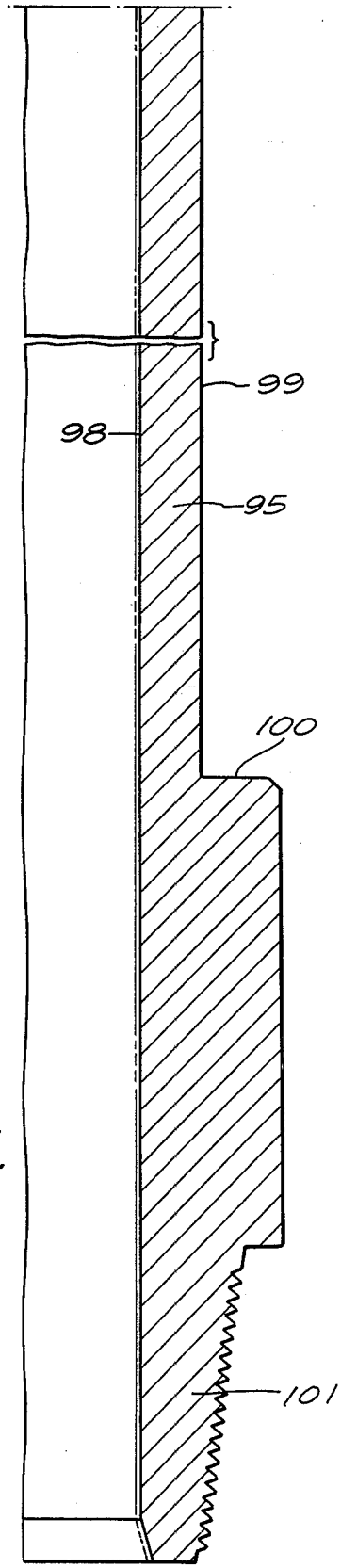

FIG. 5 is an enlarged fragmentary one-half cross sectional detail view of the "Polly Pack" seal substituted for the freely floating seal used in said patented jar.

Figure 6:
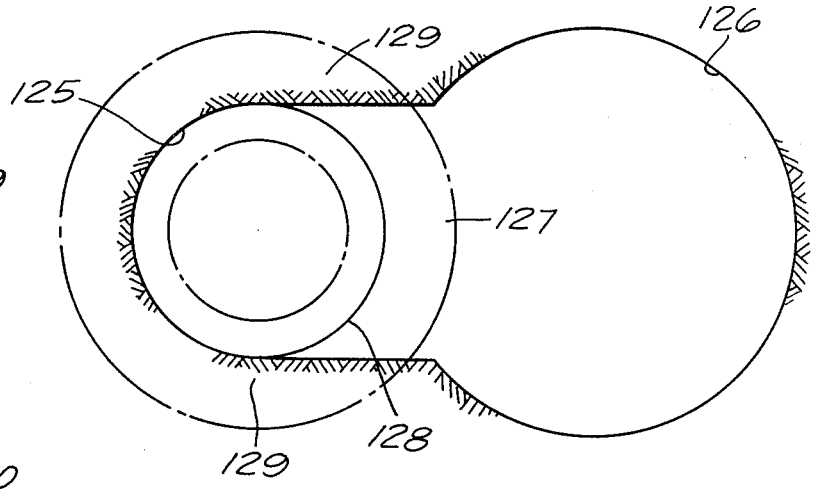

FIG. 6 is a horizontal sectional diagrammatic view showing an oil well bore which has formed therein a key-hole slot into which a drill string has drifted causing a suspended drill collar to get caught beneath the shoulders of said slot, requiring jarring action to extricate the drill string.

DETAILED DESCRIPTION OF THE PREFERRED EMBODIMENT

Referring specifically to the drawings, the invention is shown therein as embodied in a long stroke jar and bumper sub tool 10 which includes a top sub 11 having an internally threaded box (not shown) with which the jar 10 may be united with the bottom pin of a drill string 128 whereby the jar is suspended on said drill string.

The top sub 11 has a counter bore 12 extending downwardly therein leaving an annular internal shoulder 13, inner and lower faces 14 and 15 of which are turned away to form an annular downwardly and inwardly facing recess 16 which is rectangular in cross section and is annularly grooved at 17 to receive a split ring 18, for a purpose to be presently pointed out. A lower end portion of top sub 11 is radically, outwardly turned down to form, radially opposite from internal annular shoulder 13, a cylindrical surface 19 in which is formed an external annular groove 20 for capturing snugly an O-ring 21. The lower end face 15 of top sub 11 is flat and horizontal excepting for the annular recess 16 formed inwardly and downwardly therefrom. This recess is provided for mounting what is known in the art as a "Polly Pack" 25. It is held in the upper end of recess 16 by a follower ring 26 which in turn is locked in place by the lodging of split ring 18 in groove 17.

Externally, above the cylindrical face 19, top sub 11 is provided with male threads 27 in the formation of which approximately one-half of the metal of top sub 11 in the area occupied by said threads is turned away to facilitate matching engagement of threads 27 with female threads 28 provided at the upper end of an upper tubular section 29 of an outer tubular element 30 of the tool 10.

Beefing up the element 30, and, in fact, the entire tool 10, is accomplished by the introduction of a reinforcing metering sub 31 into the element 30 as the midsection thereof and using it to threadedly connect the lower end of upper section 29 to the upper end of a lower section 32 of element 30.

The upper and lower sections 29 and 32 are internally threaded at their opposite ends and the metering sub 31 is externally threaded at both ends. Screwed upwardly into the bottom end of lower tubular section 32 is the externally threaded upper end 33 of a female hexagonal spline sub 34 providing at its upper end a hammar jar impact face 35.

Internally, sub 34 is provided with a hexagonal spline bore 40, and at its lower end has a flat bumper sub impact face 41.

It is to be noted that the outside diameter of the outer tubular element 30 is uniform throughout its length and that each of the threaded joints between its respective sections includes male and female smooth faced annular formations interfitting into substantially exclude voids from the internal areas occupied by said joints. Specifically, the upper and lower outer tubular sections are made of tubing of the same internal and external diameters and the bore 42, of upper section 29 just inwardly respectively from the female threads at its upper and lower ends, makes a close sliding fit with external surface 19 on top sub 11, and with a smooth external cylindrical surface 43 provided on an upper end portion of metering sub 31, said surface having an annular groove for mounting therein a double O-ring 44, which, with O-ring 21 forms liquid tight seals between top sub 11, upper outer tubular element section 29 and metering sub 31.

Metering sub 31 not only has focused therein the structural back-bone of the tool 10, and, with the top sub 11, the upper tubular outer section 29 and an inner telescopic tubular element 45, encompasses the jar hydraulic metering system 46.

The metering sub 31 has a cylindrical bore 47 a lower end portion of which is counter bored at 48 to receive double sealing O-rings 49, backed by sleeves 50 retained in place by a snap ring 55.

At its upper extremity, the bore 47 is counter bored to produce a relatively short shallow annular restricting cylinder 56. A deeper counterbore 57 is then formed extending downward from the cylinder 56 for a distance about half the length of the metering sub 31.

The upper end of metering sub 31 is ground to a true radial sealing face 58 and the lower end of said sub provides a sub bumper impact face 59. Having a ground radial sealing bottom face 60 resting on metering sub upper ground radial sealing face 58 is a cylindrical tubular safety sleeve 61, which has a true radial upper end face 62, is slightly shorter than the vertical space between top sub 11 and metering sub 31 and is provided with four or more equally circumferentially spaced fluid escape holes 63 just below its upper end.

Further details of the construction of safety sleeve 61 will be given in the detailed description of the inner tubular element 45, with which said sleeve is associated in the hydraulic jar metering system 46.

Referring particularly to FIGS. *2a, 2b, 2c,* and *2d,* and to FIGS. 3 and 5, the inner tubular element 45 is made of a stainless steel tube having initially uniform interior and exterior diameters 64 and 65 respectively throughout its length, this tube being modified in its manufacture as follows:

At its upper tip, inner element 45 is turned down exteriorly at 70 to facilitate its insertion in Polly Pack 25, up to and including its initial external diameter 65.

In its manufacture, the inner tubular element 45 is provided either by swedging or machining or welding, or by all of these arts, with an external local annular enlargement 71 of the outer surface 65 of said element. This enlargement is machine finished to provide a band of right hand male threads 72 based on the normal external diameter 65 of inner element 45 and rising above said diameter just the amount of the depth of said threads. An upper end portion of annular enlargement 71 provides an undercut annular stop shoulder 73 and a cylindrical annularly grooved O-ring base 74 the latter being equal in radial depth to the male threads 72 and extending axially from the upper end of said male threads to said undercut shoulder 73. An O-ring 75 contractively occupies the groove in said O-ring base 74, and expands therefrom into constant sealing engagement with a smooth cylindrical counter bore 76 formed within an upper end portion of a metering sleeve 77 so as to snugly fit O-ring grooved base 74 when a band of female threads 78 formed inside said sleeve to match male threads 72, are screwed tightly onto said male threads 72 so as to force the bevelled upper end 79 of metering sleeve 77 into matching assembled relation with the inner tubular element 45 of the jar 10.

The metering sleeve 77 must travel through the cylinder 56 like a piston and this terminology may be alternatively employed for clarification in the claims and in describing the operation. For the present it will be pointed out that the radial clearance between the external annular periphery 80 of the metering sleeve (or piston) 77 and the cylinder 56 is less than one-thousandth of an inch. Dependence on the metering sleeve 77 for regulating the time interval required to effect an upward jarring blow is thus placed on turning a left-hand helical open thread like groove 85 in the sleeve periphery 80. The groove 85 preferably has a pitch of about one turn per inch in the axial length of the sleeve 77 and it has been found generally satisfactory to cut groove 85 about one-sixteenth inch wide and one-hundredth of an inch deep. This specific detail in the jar 10 however may be readily varied to adjust it to differing conditions met with in the field.

Extending downwardly from the annular enlargement 71 formed therein, the inner tubular element 45 makes a smooth sliding fit within the bore 47 of the metering sub 31 and with the double O-ring seal 49 mounted in counter bore 48 provided in the lower end of sub 31.

Referring to FIGS. *2c* and *2d,* it is noted that a substantial lower end portion of inner tubular element 45 is externally turned down to form a thin walled externally annularly grooved nipple 86 (seating an O-ring 87) and a tapered wide band of male threads 88.

Fitting up over the externally threaded lower end of inner tubular element 45, and screwing thereto by an upper set of small diameter tapered female threads 89 is a coaxially diversely interiorly diametered nut 90 having a uniform cylindrical outside face 91 which closely fits within a lower end portion of lower outer tubular section 32. The lower half 92 of nut 90 ends downwardly in an annular anvil jar impact face 93 which is supported by hammar jar impact face 35 at the moment of a jarring blow being struck, as shown in the drawings.

The large diameter female threads 94 in the lower half 92 of nut 90 are spaced concentrically outward from nipple 86 on the lower end of inner tubular element 45 and the upper end portion of a hexagonal spline male sub 95 is male threaded at 96 and counterbored at 97 to fit around the nipple 86 while element 45 is being rotated to screw the threads 94 onto the male threads 96 of sub 95.

Sub 95 has, extending downward from conterbore 97, a bore 98 equal to the bore 64 of inner tubular element 45. Sub 95 has a male hexagonal surface 99 making a splined connection with female spline bore 40.

As seen in FIGS. *2d* and 4, sub 95 has, extending downward from counterbore 97, a bore 98 equalling the bore 64 of inner tubular element 45. Sub 95 has a male hexagonal surface 99 making a splined connection with female spline bore 40. Said surface 99 terminates with the formation of a down bumper sub impact face 100 and a lower pin 101 for connecting the inner tubular element 45 to a fish to be recovered from a well.

As shown in FIGS. 1, *2b,* and *2c* the spline subs 34 and 95 are lubricated exclusively by ambient well liquid admitted to the annular space 110 between inner tubular element 45 and outer tubular element lower section 32, through two annular rows of fluid ports 111 and 112, communicating through section 32 with the upper and lower ends of said spline occupying annular space 110.

The tool 10 combines the functions of a hydraulic up-blow-striking jar and the simple coordinate function of a down-blow-striking bumper sub and the tool's safe optional use for either or both these purposes is facilitated by the addition thereto of safety sleeve 61 as will be made clear in describing the operation.

The Polly Pack 25 best performs its function when a void (vacuum) 113 is allowed to generate between the Polly Pack and the upper level 114 to which the annular operating oil chamber 115 may be supplied with operating oil 116 through the filling hole 117 provided for this use in outer element upper section 29 (See FIG. *2a*).

When said chamber is filled to level 114, the hole 117 is closed with a threaded plug 118.

Referring to FIGS. *2b* and 3, it is to be noted that the bore 119 of safety sleeve 61 is preferably made to clear the metering sleeve periphery 80, during the functioning of the tool 10, by a radial clearance of from five to fifteen one-thousandths of an inch. The effect of this will be pointed out in describing the operation.

OPERATION

FIG. 6 illustrates a key-hole slot 125 which occurs occasionally in deep well drilling practice when drilling a deep well bore 126. The section comprising this view is taken in a horizontal plane which passes through the "knee" of a "dog's leg" well bore wherein the upper initially bored portion had drifted at a substantial angle from vertical, and, following an effort to correct this, had drifted in the opposite direction away from vertical in a lower section of the bore 126. The problem occurs when the rig operator undertakes to withdraw the tools 127 from the dog's leg bore 126, and the drill string, 128, smaller in diameter than the tools, cuts a narrow vertical, key-hole slot 125 about which a pair of narrowly spaced shoulders 129 automatically form which obstruct upward withdrawal of the drill string 128 and the tools 127 through the key-hole slot 125 formed in the well bore.

The practice has been to run a bumper sub with a jar in the string 128 to loosen the tools 127 from the key-hole slot 125 by downward bumps administered alternately with upward jarring blows. The jar 10 is designed to perform both these functions which it does in the following manner.

Operational FIGS. 1, *2a*, *2b*, *2c*, *2d*, and 3 show the tool parts as related at the moment of striking an up-jarring blow by jar impact face 35 hitting jar impact face 93.

The drill string 128, top sub 11, outer tabular element 30, and female hex spline sub 34 are tensioned in delivering the jarring up-blow and diversely diametered nut 90, male hex spline sub 95 and bottom jar pin 101 are in straight aligned tension at the moment of their receiving and transmitting said up-jar blow to the key-hole captured tools 127.

The option is now presented to the rig operator of the tool 10 to lower the drill string 128 at a carefully regulated speed to bring impact face 41 into light engagement with impact face 100 signalling readiness to start another lifting of the sub 34 culminating in another up-jarring blow as shown in FIG. *2c*.

On the other hand, should the need occur for a bumper sub (down jarring) operation, the drill string may be lowered at a substantially higher speed and dependence placed on the safety sleeve 61 to prevent any excess in speed such as might damage the jar or the tools 127 being recovered.

As the outer tubular element is being lowered following an up-jarring blow, the deeper counter bore 57 passes downward freely over the metering sleeve 77 until the close fitting cylinder 56 is pressed telescopically down over said sleeve with enough force to produce a vacuum in an upper portion of counter bore 57, after which safety sleeve 61 starts being lowered over the upper end of metering sleeve 77. The closeness of the fit between sleeve 77 and safety sleeve 61, however, and the fact of their being separated by a very thin film of operating oil, will combine in lifting sleeve 61 until its upper end face 62 engages lower face 15 on top sub 11 after which it is thus propelled downwardly with the continued lowering of outer tubular element 30 until anvil face 41 comes to rest on face 100.

Due to the friction between the metering sleeve 77 and safety sleeve 61, the upper end face 62 of safety sleeve 61 will still be engaging the lower face 15 of top sub 11 and lower ground face 60 of sleeve 61 will be spaced upward from the upper ground face 58 of metering sub 31 by the same distance faces 15 and 62 are shown vertically separated in FIG. *2a*.

The frictional resistance offered by safety sleeve 61 to the downward movement of the outer tubular element 30 continues as long as measuring sleeve 77 remains covered by safety sleeve 61. This also regulates the rate of descent of the inner tubular element 45 so as to prevent heavy tools such as drill collars suspended on bottom pin 101 from suddenly dropping and being caught up with a sudden snapping blow.

The claims are:

1. In a long stoke jar and bumper sub, the combination of:

inner and outer telescopically related tubular elements;

means for connecting the upper end of the outer element to a drill string;

means for connecting the lower end of the inner element to an object to be jarred;

telescopically overlapping portions of said elements providing an annular chamber for confining an operating liquid;

an annular seal fixed on the outer element and slidably engaging the inner element to close the lower end of said chamber;

annular "Polly Pack" seal means fixed to the outer tubular element and slidably excluding ambient fluid from entering the upper end of said chamber even in the event of there being a vacuum in said chamber, said Polly Pack permitting operating fluid to escape from the upper end of said chamber should the chamber pressure exceed ambient pressure, the volume of space within said annular chamber remaining at all times constant;

a relatively short piston extending radially outwardly from said inner element into said chamber;

a relatively short cylinder formed on said outer element and extending radially inwardly therefrom into said chamber into close sliding relation with said piston when the latter is within said cylinder, said cylinder then dividing said chamber into a low pressure section, adjacent to and containing said Polly Pack seal means, and a high pressure section, adjacent to and containing said first mentioned seal, there being liquid passage means allowing operating liquid to slowly by-pass said piston, flowing from said high pressure chamber section, to said low pressure chamber section when said piston is forced through said cylinder towards said high pressure chamber section; and, impact shoulders provided on said elements in axially opposed relation to produce a jarring blow when suddenly brought together by relaxation of the restraint imposed on said piston by said cylinder as said piston completes its relative movement in one direction through said cylinder and into said high pressure chamber section;

said low pressure chamber section being adequate in length to permit a sudden compressive telescopic motion in the opposite direction between said elements immediately following said blow, which causes said piston to quickly pass through said cylinder into said low pressure chamber section, producing a temporary vacuum in said high pressure chamber section during said passage, and resetting said jar for the initiation of another upward jarring blow and delivering a bumper-sub down stroke;

the outer tubular element has a top sub into an upper box end of which a bottom pin of the drill string screws, and wherein said outer tubular element includes an upper section internally threaded at both ends, said top sub screwing into the upper of said ends; a middle metering sub externally threaded at its opposite ends and screwing up into the lower threaded end of said upper section;

a lower section internally threaded at its opposite ends and screwing upwardly onto said metering sub; and a female upwardly externally threaded spline sub having a hexagonal bore therethrough and screwing into the bottom end of said lower section, said female spline sub forming a hammer impact face at the upper end of said spline sub; and wherein the lower end of said top sub is provided with an annular internal radial groove in which said Polly Pack seal means is confined in sealing relation with said inner tubular element;

O-ring means sealing the screw connection between said top sub and said upper section of the outer tubular element, and wherein the means for connecting the lower end of the inner tubular element to an object to be jarred comprises a hexagonal male spline bottom sub terminating downward in a pin end and being externally threaded at its upper end, and after being slidably extended up through said female spline sub has screwed thereon an anvil nut, the upper half of which is radially, inwardly enlarged to provide internal threads which screw onto a relatively thin-walled externally threaded lower extremity of said inner tubular element, and provide a downward impact face in direct opposition to said impact face provided on said female spline sub.

2. A long stroke jar and bumper sub as recited in claim 1 including:

a cylindrical tubular safety sleeve loosely positioned said annular chamber between said upper section of said outer tubular element and said inner tubular element and between the lower end of said top sub and the upper end of said metering sub with a substantial vertical clearance at its upper end, contiguous meeting end edges of said safety sleeve and metering sub being ground to make a sealed fit when said sleeve rests on said sub; the inside diameter of said safety sleeve being ground to provide a clearance between the inner surface of said safety sleeve and the peripheral surface of said piston of between five and fifteen one-thousandths of one inch;

said safety sleeve having aperture means near its upper end facilitating free passage through said sleeve to an annular space between said sleeve and said upper section of said outer tubular element.

3. A long stroke jar and bumper sub as recited in claim 1, wherein:

said piston comprises an internally threaded metering sleeve which screws upwardly onto male threads provided on said inner tubular element to receive said sleeve, and force a chamferred upper end of said sleeve into an annularly undercut shoulder provided thereabove on said inner tubular element; and wherein O-ring means are provided between an upper end portion of said metering sleeve and said inner tubular element to prevent the high pressure of the operating liquid loosening said metering sleeve from said element.

4. A long stroke jar and bumper sub as recited in claim 3 wherein: said male threads on said inner tubular element are formed in a major lower portion of a cylindrical external shoulder which shoulder is co-extensive axially with said metering sleeve, the upper unthreaded portion of said shoulder being smooth and snugly fitting within a counter bore formed in a corresponding upper end portion of said metering sleeve; and wherein:

said O-ring means includes an O-ring and an annular recess to receive the same, formed in the upper unthreaded portion of said external shoulder.

5. A long stroke jar and bumper sub as recited in claim 4 wherein, the liquid passage means allowing said operating liquid to slowly by-pass said piston is embodied in the periphery of said metering sleeve and comprises a left hand helical, fluid orifice groove with a pitch of approximately three turns in the average metering sleeve and with a square cornered cross section of the groove measuring one-sixteenth of an inch wide and one-hundredth of an inch deep.

* * * * *